United States Patent [19]

Nowak

[11] 4,335,993

[45] Jun. 22, 1982

[54] HYDRAULIC-POSITIONING SYSTEM FOR HIGH-IMPACT APPLICATIONS

[75] Inventor: Andrew Nowak, Portland, Oreg.

[73] Assignee: Fluid-Air Components, Inc., Portland, Oreg.

[21] Appl. No.: 144,694

[22] Filed: Apr. 28, 1980

[51] Int. Cl.[3] ..... B27B 29/00

[52] U.S. Cl. ..... 414/748; 83/726; 91/363 R; 91/390; 91/451

[58] Field of Search ..... 83/726; 414/17, 745, 414/748; 60/413; 91/451, 390, 361, 363 R, 363 A; 92/137

[56] References Cited

U.S. PATENT DOCUMENTS

| | | | |
|---|---|---|---|
| 2,970,617 | 2/1961 | Mater | 83/726 |
| 3,088,501 | 5/1963 | Good | 83/726 |
| 4,037,502 | 7/1977 | Westfall | 83/726 |
| 4,121,504 | 10/1978 | Nowak | 92/137 |
| 4,207,805 | 6/1980 | Jonsson | 92/137 X |

FOREIGN PATENT DOCUMENTS

| | | | |
|---|---|---|---|
| 522517 | 3/1956 | Canada | 83/726 |
| 72145 | 5/1947 | Norway | 83/726 |

*Primary Examiner*—John J. Love
*Assistant Examiner*—Terrance L. Siemens
*Attorney, Agent, or Firm*—Chernoff & Vilhauer

[57] ABSTRACT

A hydraulic positioning system for precisely and rapidly positioning objects of the type likely to impose impact loadings on the system. The system is particularly adaptable for use in sawmill setworks for precisely positioning logs preparatory to sawing thereof. High impact loads are compensated for by special rapid-acting shock-absorbing hydraulic relief circuitry responsive to differences between impact overpressure and system pressure.

7 Claims, 3 Drawing Figures

FIG. 1
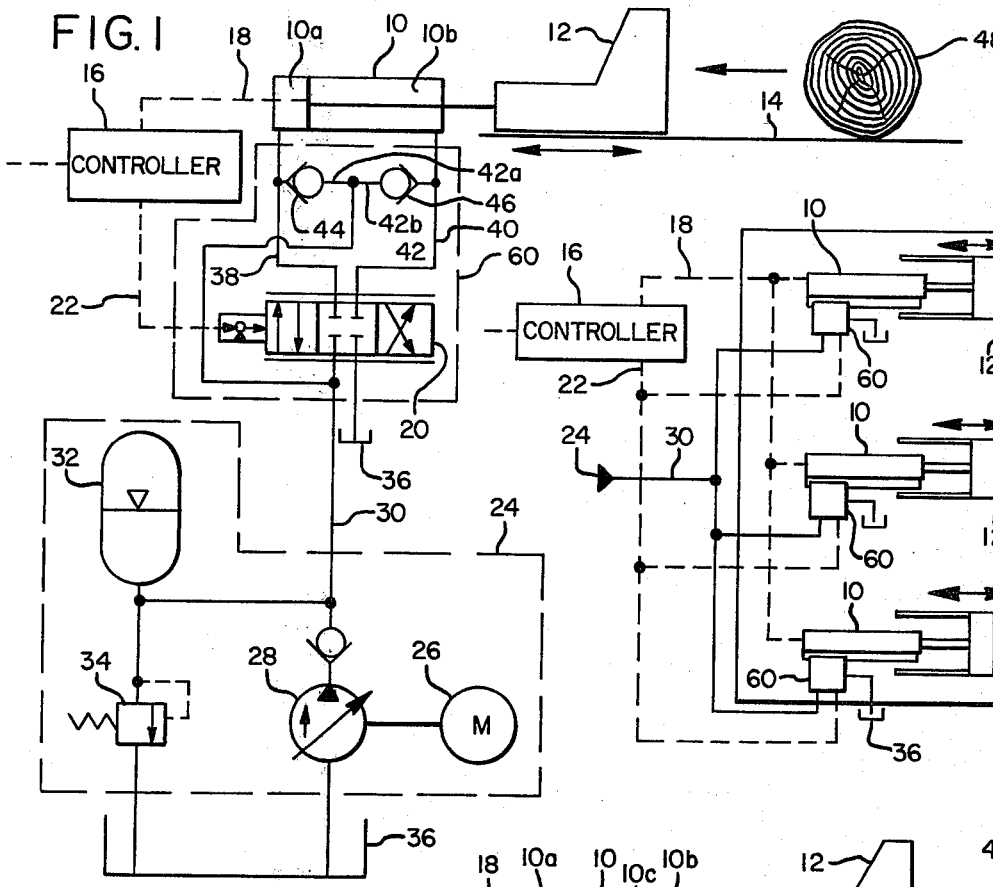
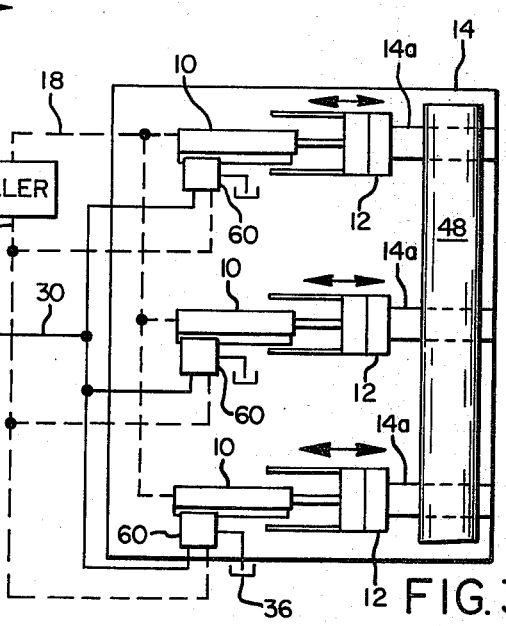
FIG. 3
FIG. 2
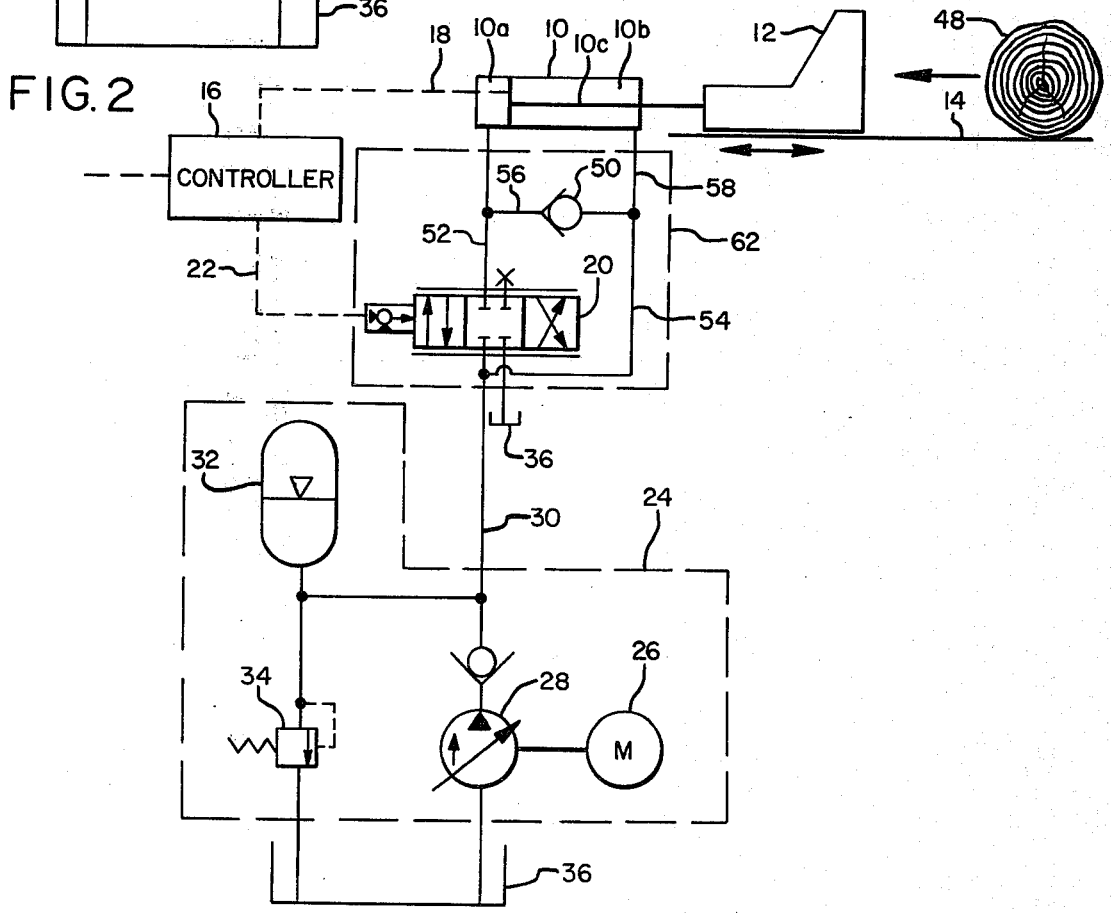

HYDRAULIC-POSITIONING SYSTEM FOR HIGH-IMPACT APPLICATIONS

BACKGROUND OF THE INVENTION

This invention relates to improvements in hydraulic positioning apparatus for precisely and rapidly positioning objects of the type likely to exert high impact or shock loads on the positioning apparatus. In particular, the invention relates to improvements in hydraulic positioning apparatus of the automatic type in which a controller responsive to the position of the apparatus automatically controls its movements so as to obtain precise positioning. The invention is especially applicable, although not limited, to sawmill setworks for precisely positioning logs preparatory to sawing thereof, and to the use of linear hydraulic piston and cylinder positioning assemblies in such setworks.

Precise automatic hydraulic positioning devices of both the rotary and linear (i.e. piston and cylinder) types have been known for many years. An example of an exceptionally precise automatic linear positioning assembly, of a type capable of positioning objects to within several thousandths of an inch, is described in U.S. Pat. No. 4,121,504 issued Oct. 24, 1978, the text of which is incorporated herein in its entirety by this reference. The rapid, yet precise positioning function performed by devices of this type is made possible by the fine modulation of a servo valve which is controlled automatically by a controller responsive to the position of the movable element of the hydraulic positioning device. The actual position of the movable element is compared to a predetermined or desired position and the valve is modulated to achieve and retain such position. Moreover the automatic controller also controls acceleration, velocity and deceleration of the positioning device which is necessary for rapid as well as precise positioning. To accomplish all of this, the hydraulic components of the system, particularly the seals, servo valve modulating surfaces and internal moving surfaces of the hydraulic motor itself, must be in good condition so that undue leakage, friction or other obstacles do not hinder the precise control function.

Because of the foregoing requirements of such a hydraulic positioning system, difficulty has been encountered when attempting to apply such a system to the positioning of objects of the type expected to impose substantial impact loads on the system. Such impact loads can instantly increase hydraulic pressure to many times that for which the system was designed, leading to rapid deterioration or destruction of seals, valves and other components such that the system either becomes rapidly unreliable or requires an unreasonably high degree of continuous maintenance.

Previous methods of reducing the effect of impact loads on hydraulic systems have included interposing cushioning pneumatic bags or cylinders between the hydraulic motor and either its mount or the impact load. However these permit a nonrigid connection between the hydraulic device and the object to be positioned, and therefore are not compatible with the precision and quickness required of automatic positioning systems.

One commonly attempted method of attempting to overcome the problem of impact loading in automatic positioning systems is depicted in FIG. 7 of the aforementioned U.S. Pat. No. 4,121,504. This is the provision of a spring-operated pressure-relief valve which is intended to relieve overpressures which may occur on either side of the piston and cylinder assembly by exhausting overpressurized fluid to the sump. The problem with this arrangement is that the spring-operated pressure-relief valve is too slow to relieve instantaneously-applied impact pressure, especially when interposed between the servo control valve and the piston and cylinder assembly. The springs of such valves are heavy and operate over a substantial pressure range between full closure and full opening of the valve. In the time that it takes for the valve to open sufficiently to relieve impact pressure the damage from particularly high impact loads will already have occurred. What is needed is a system that is so fast-acting that the impact pressure is prevented from building up despite the instantaneous nature of the impact load.

A particularly appropriate potential application of automatic hydraulic positioning system exists with respect to sawmill setworks wherein carriages with transversely-movable setting knees receive and position logs preparatory to sawing. The log is moved onto the carriage with substantial momentum and impacts with great force against the setting knees, which then position the log precisely for sawing so as to obtain optimum yield from the particular log. A plurality of setting knees are spaced along the carriage and, pursuant to modern requirements, the knees are movable independently of one another so as to achieve infinite angular adjustment of the log with respect to the saws (known as achieving "infinite taper"). It has been known to use linear hydraulic piston and cylinder assemblies to position the setting knees of such setworks, but these are of the much less efficient, nonautomatic manually-controlled type where the absence of automatic controls makes deterioration and imprecision of the hydraulic system more tolerable. Because of the extremely high impact loads imposed by the logs on such a system, however, no automatic linear hydraulic positioning systems having precise, rapid automatic positioning have previously been employed to position the setting knees. Instead, ballscrew drives have been employed where automatic positioning is desired. However, a great disadvantage of using ballscrews has been the low setting speed of the knees. Also, to achieve infinite taper, each knee must have an individual ballscrew drive, which results in an extremely expensive system.

SUMMARY OF THE PRESENT INVENTION

The present invention provides a hydraulic positioning system which has novel shock-absorbing features which are compatible with the precision and quickness required of automatic hydraulic positioning systems and yet are sufficiently fast-acting to prevent damage to seals, valves and other hydraulic components under extremely high impact loads, thereby maintaining the precision of the system over extended operating periods despite such impact loading. The system makes it possible, for the first time, to reliably use automatic rotary and linear hydraulic positioning motors in extremely high impact applications, and particularly to use automatic linear hydraulic positioning motors, i.e. automatically-controlled piston and cylinder assemblies, on sawmill setworks carriages to reliably position setting knees to within a few thousandths of an inch despite the huge impact loads exerted on the knees by the placement of each log on the carriage.

Rather than relying on the presence of cushioning pneumatic devices, which would cause imprecise and slow positioning, or on spring-operated relief valves which are too slow acting to relieve high impact pressures adequately, the present invention provides a system whereby pressure in the hydraulic positioning motor is constantly balanced against system pressure at the source of pressurized hydraulic fluid through a simple one-way check valve which opens fully instantaneously and allows immediate relief of over-pressurized fluid when the pressure of fluid in the motor exceeds system supply pressure by a small predetermined amount (usually the amount needed to overcome a weak biasing spring which is merely strong enough to urge the one-way valve toward closure when the pressures on both sides thereof are equal). This type of system, wherein impact pressure must merely overcome system pressure to accomplish full relief thereof, is significantly faster acting than previous relief systems and is thus able to prevent high impact pressures from shock loads.

The principle of operation of the system involves relieving the fluid not merely to a sump, as in conventional relief valve arrangements, but rather to the system's source of pressurized fluid. This requires a certain volumetric elasticity of the pressurized fluid source so that it can immediately accept overpressurized fluid from the hydraulic motor through the one-way valve upon impact. Preferably this elasticity is provided by an accumulator. It is conceivable, however, that in some applications the elasticity provided by long hydraulic conduits between the hydraulic motor and the fluid source, combined with the limited compressibility of hydraulic oil and the eventual relief provided by a slow acting relief valve located at the source of pressurized fluid (i.e. remote from the hydraulic motor and separated therefrom by a servo valve) might provide sufficient volumetric elasticity.

The system can protect one or both sides of a double-acting positioning motor, depending on the application, and although well-suited for nonregenerative systems is especially adaptable for use in regenerative systems which transfer fluid from one side of a motor to the other side thereof. In the regenerative application, only a single one-way valve is required to protect both sides of the motor, and the system can completely prevent cavitation in the direction of highest expected impact.

It is therefore a principal objective of the present invention to provide an automatic hydraulic rotary or linear positioning system which has shock-absorbing features compatible with the required precision and quickness of such an automatic system and yet is sufficiently fast acting to protect the system from adverse effects of extremely high impact loads.

It is a further principal objective of the present invention to provide a sawmill setworks having an automatic hydraulic linear positioning system of high precision and quickness for independently positioning the individual setting knees thereof.

The foregoing and other objectives, features and advantages of the present invention will be more readily understood upon consideration of the following detailed description of the invention taken in conjunction with the accompanying drawings.

BRIEF DESCRIPTION OF THE DRAWINGS

FIG. 1 is a schematic diagram of a nonregenerative embodiment of the present invention as applied to a sawmill setworks.

FIG. 2 is a schematic diagram of a regenerative embodiment of the invention as applied to a sawmill setworks.

FIG. 3 is a schematic, simplified top view of an exemplary sawmill setworks utilizing the present invention.

DETAILED DESCRIPTION OF THE INVENTION

As shown in the figures, a linear hydraulic motor such as a selectively extensible piston and cylinder assembly 10 is shown connected to a setting knee 12 or equivalent log-positioning member. Both the piston and cylinder assembly 10 and setting knee 12 are mounted upon a carriage 14, the setting knee being linearly reciprocable on the carriage in response to the extension or retraction of the piston and cylinder assembly 10. A controller 16 is responsive, through any suitable connection depicted by the dotted line 18, to the reciprocating position of the setting knee 12 (in this case by sensing the extensible position of the piston of the piston and cylinder assembly 10), and automatically controls a servo valve 20 through a control connection 22 so as to position the setting knee 12 precisely in accordance with predetermined position data which has been preset in the controller 16. The controller 16 also preferably controls acceleration, velocity and deceleration of the setting knee through modulation of the servo valve 20. Preferably the automatic position sensing and controlling functions of the system are carried out in accordance with the structures shown in the aforementioned U.S. Pat. No. 4,121,504. However functionally equivalent arrangements satisfactory for the purpose are available on the market. Moreover, although a single three-position servo valve 20 is shown for controlling the extension and retraction of the piston and cylinder assembly, multiple separate valves controlling extension and retraction respectively could alternatively be used. Also the system is useful in many applications other than sawmill setworks. If the motion of the member to be positioned is linear, then a linear hydraulic motor such as that depicted in the figures is probably the most precise motor to use, since intermediate linkage is minimized. However if the member to be positioned has a rotary motion, it may well be that a rotary hydraulic motor would be preferable. All of these alternative possibilities are within the scope of the present invention.

In the figures the servo valve 20 receives hydraulic fluid from a source of pressurized hydraulic fluid indicated collectively by the elements contained within the phantom outline 24. These elements may include a prime mover such as an electric motor 26 which drives a suitable pump, such as a variable displacement, pressure-compensated hydraulic pump 28, which supplies hydraulic fluid under pressure to the servo valve through a fluid conduit 30. The source of pressurized hydraulic fluid also preferably includes an accumulator 32 and conventional spring-operated pressure-relief valve 34. The system draws fluid from, and returns fluid to, a reservoir 36.

In the nonregenerative embodiment of the system depicted in FIG. 1, extension of the piston and cylinder assembly 10 is accomplished by the actuation of the servo valve 20 by the controller 16 to move the valve toward the right as shown in FIG. 1. This introduces fluid under pressure to chamber **10*a* through conduit 38 while simultaneously exhausting fluid from chamber 10*b* through conduit 40. Retraction of the piston and cylinder assembly 10 is accomplished by movement of valve 20 to the left which introduces pressurized fluid to chamber 10***b* through conduit 40 while exhausting fluid from chamber 10*a* through conduit 38. When valve 20 is centered, fluid under pressure is prevented from entering either chamber 10*a* or 10*b* through parallel conduits 42, 42*a* and 42*b* respectively, which bypass valve 20, by virtue of one-way valves 44 and 46 respectively. Likewise, these one-way valves prevent the exhaust of pressurized fluid from the source 24 through the servo valve 20 when the valve 20 is in its right or left-hand positions.

The exertion of high instantaneous impact loading upon the piston and cylinder assembly 10 is exemplified in the figures by the movement of a log 48 into abutment with the setting knee 12. In the exemplary sawmill setworks illustrated in the figures, this impact-producing motion occurs each time a log is loaded onto the carriage 14 and thus occurs repeatedly in normal operation. Since the log has a high mass, a substantially instantaneous rise in the pressure of hydraulic fluid in chamber 10*a* occurs, which can be to a level many times the pressure produced by the source 24 unless the pressure in chamber 10*a* is instantaneously relieved. Without such instantaneous relief, the seals of the piston and cylinder assembly 10 and of the servo valve 20, the various hydraulic couplings and conduits and the high-tolerance modulating surfaces of the servo valve 20 can all become quickly deteriorated with the result that precise and rapid automatic control are no longer reliably obtained, thereby defeating the system.

In the present invention, relief of the pressure in the chamber 10*a* is obtained so instantaneously that there is little increase in pressure in the system as a result of the impact. This is because, immediately upon impact, fluid in chamber 10*a* is exhausted through one-way valve 44 and conduits 42*a* and 42 into the source of pressurized fluid 24. In this regard it is significant that one-way valve 44 is of a type whose opening and closure is responsive substantially entirely to the difference between pressure in chamber 10*a* and pressure at source 24 exerted through conduits 42 and 42*a*. Only a weak biasing spring (not shown) is incorporated into valve 44 to bias the valve toward closure when the pressures on both sides thereof are equal. Such weak biasing spring is overcome by a small differential pressure, for example on the order of 3 psi so that if system pressure at the source 24 is 2000 psi valve 44 will fully open as soon as the pressure in chamber 10*a* reaches as little as 2003 psi. This full relief action occurs instantaneously, and is to be sharply contrasted with the action of a conventional spring-operated relief valve which, rather than opening primarily in response to a pressure differential across the valve, opens gradually in response to upstream pressure overcoming the compression of a heavy spring. The fact that such a relief valve opens only gradually in response to overpressure, requiring a substantial overpressure to open the valve fully, makes such a valve too slow-acting to prevent the harmful instantaneous increase in pressure caused by the impact load.

Because of the pressure differential principle upon which the relief function of the present invention operates (as opposed to relieving to the reservoir 36 as would be the case with a conventional spring-operated relief valve), the source 24 must have a certain degree of volumetric elasticity in order to accept the overpressurized fluid. This volumetric elasticity is preferably provided by an accumulator such as 32. However in some applications it may be sufficient, if the source 24 is located sufficiently remote from the chamber 10*a*, that the elasticity of the conduits 30, 42 and 42*a*, coupled with the limited compressibility of hydraulic oil and the slow relief afforded for example by the relief valve 34 at the remote source 24, might provide sufficient cushioning to prevent severe impact overpressure if the impact load is sufficiently small.

In the particular embodiment shown, impact loads applied in a direction opposite to the movement of the log 48 would be relatively smaller, resulting possibly from too rapid stopping of the setting knee 12 during extension of the piston and cylinder assembly. However in other applications impact relief in both directions may be of equal importance. In any case, impact relief for chamber 10*b* is provided through one-way valve 46 and conduits 42*b* and 42 in the same manner previously described with respect to one-way valve 44.

Relieving overpressurized fluid through the above-described one-way valve directly to the source of pressurized fluid 24 which supplies the motor 10 is the simplest and preferred way of practicing the present invention since it utilizes the source 24 also as a shock-absorbing circuit. However it would of course be satisfactory, although more complicated, to relieve the overpressurized fluid through such a one-way valve to a shock-absorbing pressurized fluid circuit or accumulator other than the source 24, so long as the separate circuit or accumulator maintains fluid at a pressure at least equal to that of the source 24 and can accept overpressurized fluid through the one-way valve upon impact.

In FIG. 2, a more advantageous arrangement for obtaining instantaneous bidirectional relief of impact loads utilizing the principles of the present invention in a regenerative circuit is shown. The system is similar to that previously described with respect to FIG. 1, with like components having the same reference numerals. The only difference occurs in the interconnection of the fluid source 24 and servo valve 20 with the piston and cylinder assembly 10. It will be noted, for example, that servo valve 20 is interconnected controllably through a fluid conduit 52 only with chamber 10*a* of the piston and cylinder assembly. To extend the piston and cylinder assembly, valve 20 is moved toward the right in FIG. 1 introducing pressurized fluid from the source 24 through conduit 52 to chamber 10*a*. Hydraulic fluid is exhausted simultaneously from chamber 10*b* against system pressure through conduit 54 which, by virtue of its junction with pressurized fluid supply conduit 30, recirculates the exhausted fluid into chamber 10*a*, thereby requiring pump 28 to supply only a sufficient volume of fluid to equal the volume of that portion of the piston rod 10*c* being extended. In view of the fact that the fluid pressures on both sides of the piston are equal in a regenerative circuit, extension of the piston is caused by the fact that the working area of the piston exposed to chamber 10*a* is greater than its working area exposed to chamber 10*b* by a difference which is equal to the cross-sectional area of the piston rod 10*c*.

Retraction of the piston and cylinder assembly 10 is accomplished by movement of valve 20 toward the left as shown in FIG. 2, whereby fluid under pressure is introduced through conduit 54 into chamber 10*b* and fluid is simultaneously exhausted from chamber 10*a* to the reservoir 36 through conduit 52. The exhaust of fluid is under the modulating control of valve 20 which thereby controls the rate and degree of retraction of the piston even though the valve 20 has no direct control over the flow of pressurized fluid in conduit 54.

Upon the exertion of an impact load tending to retract the piston and cylinder assembly 10, such as that produced by the movement of the log 48 against the setting knee 12, the overpressurized fluid in chamber 10*a* is instantaneously relieved through conduit 56, one-way valve 50 and conduit 54 into the pressurized source 24 in the same manner as previously described with respect to one-way valve 44. The opening and closure of valve 50 is likewise responsive to the difference between the pressure of fluid in chamber 10*a* and the pressure of fluid at the source 24. A benefit of the regenerative circuit of FIG. 2 during this pressure-relief function, which is not present in the nonregenerative circuit of FIG. 1, is the fact that a portion of the relieved fluid flowing through one-way valve 50 is recirculated through conduit 58 into chamber 10*b* under pressure, thereby preventing cavitation in chamber 10*b*. This cavitation prevention feature can be important if impact loading is exceptionally high, although under most circumstances a small degree of cavitation would not be harmful.

Impact loading in the opposite direction, i.e. in the direction of extension of the piston and cylinder assembly 10, is relieved by permitting the exhaust of fluid from chamber 10*b* directly through conduits 58 and 54 into the source 24. It will be noted that, in a regenerative circuit, no second one-way valve is required in conduit 58 for the relief of chamber 10*b*, as was the case with respect to the nonregenerative system of FIG. 1. The relief of chamber 10*b* still operates on the same pressure differential principle, but reverse flow through conduit 58 is permitted.

FIG. 3 is a simplified schematic top view showing the system as installed on a sawmill setworks carriage having three individually-controllable setting knees. The assemblies which include a servo valve 20 and the associated one-way valves and relief circuitry enclosed by the phantom outline 60 in FIG. 1 are shown as single compact units 60 in FIG. 3. For regenerative applications, these may alternatively constitute the assembly enclosed by the outline 62 in FIG. 2. The carriage 14 is of elongate shape having a series of upwardly-facing spaced surfaces 14*a* for supporting a log 48 longitudinally with respect to the carriage 14. The log-positioning setting knees 12 are spaced longitudinally along the carriage 14 and are movably mounted on the carriage for reciprocation in a direction transverse to the longitudinal dimension of the carriage, each setting knee being reciprocable in response to the extension or retraction of a respective piston and cylinder assembly 10. The source of pressurized hydraulic fluid 24 supplies all of the piston and cylinder assemblies through the conduit 30, and the controller 16 likewise senses the positions of the various pistons through connection 18 and controls the extension or retraction of each piston and cylinder assembly separately through connection 22 in response to the position of each piston in comparison with predetermined criteria. With the log properly positioned by the setting knees, the carriage moves longitudinally so as to feed the log longitudinally with respect to the sawblades.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A hydraulic positioning system for movably positioning a member subject to impact loading, said system comprising:

(a) hydraulic motor means having a chamber for receiving hydraulic fluid under pressure for moving said member in a predetermined direction in response to the introduction of hydraulic fluid under pressure into said chamber;

(b) a source of pressurized hydraulic fluid for supplying hydraulic fluid under pressure to said chamber;

(c) first fluid conduit means interconnecting said source of pressurized hydraulic fluid with said chamber for conducting said fluid to said chamber, said first fluid conduit means having fluid control valve means interposed therein for selectively permitting or preventing the flow of said fluid from said source of pressurized hydraulic fluid to said chamber through said first fluid conduit means;

(d) second fluid conduit means interconnecting said source of pressurized hydraulic fluid with said chamber in parallel relationship with said first fluid conduit means and bypassing said control valve means;

(e) said second fluid conduit means having one-way valve means interposed therein for preventing the flow of hydraulic fluid through said second fluid conduit means from said source of pressurized hydraulic fluid toward said chamber, said one-way valve means having means responsive to differences between the pressures of hydraulic fluid in said chamber and at said source of pressurized hydraulic fluid fluid respectively for permitting the flow of fluid through said one-way valve means and said second fluid conduit means from said chamber toward said source of pressurized hydraulic fluid when the pressure of hydraulic fluid in said chamber exceeds the pressure of hydraulic fluid at said source of pressurized hydraulic fluid by a predetermined amount;

(f) means automatically responsive to the movable position of said member for actuating said fluid-control valve means so as to cause said hydraulic motor means to place said member in a predetermined position;

wherein said hydraulic motor means is mounted upon an elongate carriage having upwardly-facing means for supporting a log longitudinally with respect to said carriage, said member comprising a log-positioning member movably mounted upon said carriage for transversely positioning a log on said carriage in response to the introduction of hydraulic fluid under pressure into said chamber of said hydraulic motor means.

2. A hydraulic positioning system for movably positioning a member subject to impact loading, said system comprising:

(a) hydraulic motor means having a chamber for receiving hydraulic fluid under pressure for moving said member in a predetermined direction in response to the introduction of hydraulic fluid under pressure into said chamber;

(b) a source of pressurized hydraulic fluid for supplying hydraulic fluid under pressure to said chamber;

(c) first fluid conduit means interconnecting said source of pressurized hydraulic fluid with said chamber for conducting said fluid to said chamber, said first fluid conduit means having fluid control valve means interposed therein for selectively permitting or preventing the flow of said fluid from said source of pressurized hydraulic fluid to said chamber through said first fluid conduit means;

(d) shock-absorbing means containing pressurized hydraulic fluid at a pressure at least as great as the pressure of hydraulic fluid at said source of pressurized hydraulic fluid;

(e) second fluid conduit means interconnecting said chamber with said shock-absorbing means independently of said control valve means;

(f) said second fluid conduit means having one-way valve means interposed therein for preventing the flow of hydraulic fluid through said second fluid conduit means from said shock-absorbing means toward said chamber, said one-way valve means having means responsive to differences between the pressures of hydraulic fluid in said chamber and in said shock-absorbing means respectively for permitting the flow of fluid through said one-way valve means and said second fluid conduit means from said chamber toward said shock-absorbing means when the pressure of hydraulic fluid in said chamber exceeds the pressure in said shock-absorbing means by a predetermined amount;

(g) means automatically responsive to the movable position of said member for actuating said fluid-control valve means so as to cause said hydraulic motor means to place said member in a predetermined position; wherein said hydraulic motor means is mounted upon an elongate carriage having upwardly-facing means for supporting a log longitudinally with respect to said carriage, said member comprising a log-positioning member movable mounted upon said carriage for transversely positioning a log on said carriage in response to the introduction of hydraulic fluid under pressure into said chamber of said hydraulic motor means.

3. A hydraulic positioning system for movably positioning logs preparatory to sawing thereof, said system comprising:

(a) an elongate carriage having upwardly-facing means for supporting a log longitudinally with respect to said carriage;

(b) a plurality of log-positioning members spaced longitudinally along said carriage and movably mounted thereon for reciprocation in a direction transverse to the longitudinal dimension of said elongate carriage;

(c) a plurality of selectively extensible and retractable hydraulic piston and cylinder assemblies mounted upon said carriage, each connected to a respective one of said log-positioning members for reciprocating the respective member by the extension and retraction of the respective piston and cylinder assembly;

(d) a source of pressurized hydraulic fluid for supplying hydraulic fluid under pressure to said piston and cylinder assemblies;

(e) a plurality of fluid control valve means, each interposed between said source of pressurized hydraulic fluid and a respective one of said piston and cylinder assemblies, for selectively directing fluid under pressure to extend or retract each of said respective piston and cylinder assemblies separately from one another;

(f) means automatically responsive to the reciprocating position of each of said log-positioning members for actuating each of said respective fluid control valve means so as to cause each of said respective piston and cylinder assemblies to place a respective log-positioning member in a predetermined reciprocating position; and (g) shock-absorbing hydraulic circuit means connected to each of said respective piston and cylinder assemblies for preventing the pressure of hydraulic fluid tending to extend the respective assembly from exceeding a predetermined pressure.

4. The system of claim 3 wherein each of said piston and cylinder assemblies has a first chamber for receiving hydraulic fluid under pressure to extend the assembly and a second chamber for receiving hydraulic fluid under pressure to retract the assembly, further including respective first fluid conduit means interconnecting said source of pressurized hydraulic fluid with each respective first chamber of said respective piston and cylinder assemblies, each of said first fluid conduit means having a respective one of said fluid-control valve means interposed therein for selectively permitting or preventing the flow of said fluid from said source of pressurized hydraulic fluid to the respective first chamber through the respective first fluid conduit means, shock-absorbing means containing pressurized hydraulic fluid at a pressure at least as great as the pressure of hydraulic fluid at said source of pressurized hydraulic fluid, and respective second fluid conduit means interconnecting each first chamber of said respective piston and cylinder assemblies with said shock-absorbing means independently of said control valve means, each of said respective second fluid conduit means having a respective one-way valve means interposed therein for preventing the flow of hydraulic fluid through the respective second fluid conduit means from said shock-absorbing means toward a respective first chamber, each of said respective one-way valve means having means responsive to differences between the pressures of hydraulic fluid in the respective first chamber and in said shock-absorbing means respectively for permitting the flow of fluid through the respective one-way valve means and the respective second fluid conduit means from the respective first chamber toward said shock-absorbing means when the pressure of hydraulic fluid in the respective first chamber exceeds the pressure of hydraulic fluid in said shock-absorbing means by a predetermined amount.

5. The system of claim 4, further including respective third fluid conduit means interconnecting each respective second chamber of a respective piston and cylinder assembly with the respective second fluid conduit means connected to the first chamber of the respective piston and cylinder assembly and also with said shock-absorbing means for conducting a portion of said flow of fluid through the respective one-way valve means into the respective second chamber.

6. The system of claim 4 or 5 wherein said shock-absorbing means includes accumulator means for storing a variable volume of hydraulic fluid under pressure.

7. The system of claim 4 or 5 wherein said shock-absorbing means includes relief means for permitting escape of hydraulic fluid from said shock-absorbing means while maintaining the pressure of hydraulic fluid therein within a predetermined range.

* * * * *

UNITED STATES PATENT AND TRADEMARK OFFICE

CERTIFICATE OF CORRECTION

PATENT NO. : 4,335,993

DATED : June 22, 1982

INVENTOR(S) : Andrew Nowak

It is certified that error appears in the above-identified patent and that said Letters Patent are hereby corrected as shown below:

Col. 2, line 17 Change "system" to --systems--;

Col. 2, line 42 After "However" delete the comma (,).

Signed and Sealed this

*Nineteenth* Day of *October 1982*

[SEAL]

*Attest:*

GERALD J. MOSSINGHOFF

*Attesting Officer*

*Commissioner of Patents and Trademarks*